US009453272B2

(12) United States Patent
Vo et al.

(10) Patent No.: US 9,453,272 B2
(45) Date of Patent: Sep. 27, 2016

(54) ALUMINUM SUPERALLOYS FOR USE IN HIGH TEMPERATURE APPLICATIONS

(71) Applicants: NanoAL LLC, Skokie, IL (US); Northwestern University, Evanston, IL (US)

(72) Inventors: Nhon Q Vo, Skokie, IL (US); David N Seidman, Skokie, IL (US); David C Dunand, Evanston, IL (US)

(73) Assignee: NanoAl LLC, Skokie, IL (US)

( * ) Notice: Subject to any disclaimer, the term of this patent is extended or adjusted under 35 U.S.C. 154(b) by 0 days.

(21) Appl. No.: 14/645,654

(22) Filed: Mar. 12, 2015

(65) Prior Publication Data

US 2015/0259773 A1 Sep. 17, 2015

Related U.S. Application Data

(60) Provisional application No. 61/951,591, filed on Mar. 12, 2014, provisional application No. 61/978,667, filed on Apr. 11, 2014.

(51) Int. Cl.
*C22C 21/02* (2006.01)
*C22C 21/06* (2006.01)
(Continued)

(52) U.S. Cl.
CPC ..... *C22F 1/04* (2013.01); *C22C 1/026* (2013.01); *C22C 21/00* (2013.01)

(58) Field of Classification Search
CPC ..... C22F 1/04; C22F 1/043; C22F 1/047; C22F 1/05; C22C 1/026; C22C 21/00; C22C 21/02; C22C 21/04; C22C 21/06; C22C 21/08
See application file for complete search history.

(56) References Cited

U.S. PATENT DOCUMENTS 3,551,143 A 12/1970 Marukawa et al.
3,807,969 A 4/1974 Schoerner et al.
(Continued)

FOREIGN PATENT DOCUMENTS

EP 0558 957 A2 9/1993

OTHER PUBLICATIONS

Jun. 25, 2015 ISR for PCT/US2015/020218.
(Continued)

*Primary Examiner* — Lois Zheng
(74) *Attorney, Agent, or Firm* — Hahn Loeser & Parks, LLP

(57) ABSTRACT

Aluminum-zirconium and aluminum-zirconium-lanthanide superalloys are described that can be used in high temperature, high stress and a variety of other applications. The lanthanide is preferably holmium, erbium, thulium or ytterbium, most preferably erbium. Also, methods of making the aforementioned alloys are disclosed. The superalloys, which have commercially-suitable hardness at temperatures above about 220° C., include nanoscale $Al_3Zr$ precipitates and optionally nanoscale $Al_3Er$ precipitates and nanoscale $Al_3(Zr,Er)$ precipitates that create a high-strength alloy capable of withstanding intense heat conditions. These nanoscale precipitates have a $L1_2$-structure in α-Al(f.c.c.) matrix, an average diameter of less than about 20 nanometers ("nm"), preferably less than about 10 nm, and more preferably about 4-6 nm and a high number density, which for example, is larger than about $10^{21}$ $m^{-3}$, of the nanoscale precipitates. The formation of the high number density of nanoscale precipitates is thought to be due to the addition of inoculant, such as a Group 3A, 4A, and 5A metal or metalloid. Additionally, methods for increasing the diffusivity of Zr in Al are disclosed.

31 Claims, 9 Drawing Sheets

(51) Int. Cl.

| | |
|---|---|
| ***C22F 1/04*** | (2006.01) |
| ***C22C 21/00*** | (2006.01) |
| ***C22C 1/02*** | (2006.01) |

(56) References Cited

U.S. PATENT DOCUMENTS

| | | | | |
|---|---|---|---|---|
| 5,087,301 | A * | 2/1992 | Angers | B22F 9/008 148/415 |
| 5,327,955 | A | 7/1994 | Easwaran | |
| 5,449,421 | A | 9/1995 | Hamajima et al. | |
| 5,976,214 | A | 11/1999 | Kondoh et al. | |
| 6,149,737 | A | 11/2000 | Hattori et al. | |
| 6,592,687 | B1 | 7/2003 | Lee et al. | |
| 6,918,970 | B2 | 7/2005 | Lee et al. | |
| 8,323,373 | B2 | 12/2012 | Haynes, III et al. | |
| 2003/0192627 | A1 * | 10/2003 | Lee | C22C 21/04 148/439 |
| 2010/0143177 | A1 * | 6/2010 | Pandey | C22C 1/0416 419/30 |
| 2011/0017359 | A1 | 1/2011 | Pandey | |
| 2012/0000578 | A1 * | 1/2012 | Wang | C22C 21/02 148/549 |
| 2013/0199680 | A1 | 8/2013 | Apelian et al. | |
| 2013/0220497 | A1 * | 8/2013 | Huskamp | C22C 21/00 148/688 |

OTHER PUBLICATIONS

Jun. 25, 2015 Written Opinion of ISA for PCT/US2015/020218.

A.L. Berezina et al., "Decomposition Processes in the Anomalous Supersaturated Solid Solution of Binary and Ternary Aluminum Alloys Alloyed with Sc and Zr," *Acta Physica Polonica A*, vol. 122, No. 3, pp. 539-543 (Sep. 8, 2011).

H. Huang et al., "Age Hardening Behavior and Corresponding Microstructure of Dilute Al—Er—Zr Alloys," *Metallurgical and Materials Transactions A*, vol. 44A, pp. 2849-2856 (Jan. 26, 2013).

Y.W. Riddle et al., "A Study of Coarsening, Recrystallization, and Morphology of Microstructure in Al—Sc—(Zr)—(Mg) Alloys," *Metallurgical and Materials Transactions A*, vol. 35A, pp. 341-350 (Jan. 2004).

Jun. 6, 2016 Transmittal of International Search Report and Written Opinion of International Searching Authority for PCT/US2016/021094.

C. Booth-Morrison et al., "Effect of Er Addition on ambient and high-temperature strength of precipitation-strengthened Al—Zr—Sc—Si alloys," *Acta Mater* 60, 3643-3654 (2012).

C. Booth-Morrison et al., "Role of Silicon in Accelerating the Nucleation of Al3(Sc,Zr) Precipitates in Dilute Al—Sc—Zr Alloys," *Acta Mater* 60, 4740-4752 (2012).

C. B. Fuller et al., "Temporal Evolution of the Nanostructure of Al(Sc,Zr) Alloys: Part I—Chemical Compositions of Al3(Sc1—xZrx) Precipitates," *Acta Mater* 53, 5401-5413 (2005).

H. Hallem et al., "The Formation of Al3ScxZryHf1-x-y) Dispersoids in Aluminium Alloys," *Mater Sci Eng A* 421, 154-160 (2006).

S. Hori et al., "Effect of Small Addition of Si on the Precipitation of Al—0.6%Zr Alloys," *J Jpn Inst Light Met* 28, 79-84 (1978).

K. E. Knipling et al., "Ambient- and High-Temperature Mechanical Properties of Isochronally Aged Al—0.06Sc, Al—0.06Zr and Al—0.06Sc—0.06Zr (at.%) Alloys," *Acta Mater* 59, 943-954 (2011).

K.E. Knipling et al., "Atom-Probe Tomographic Studies of Precipitation in Al—0.1Zr—0.1Ti (at.%) Alloys," *Microscopy and Microanalysis* 13, 1-14 (2007).

K.E. Knipling et al., "Creep resistance of cast and aged Al—0.1Zr and Al—0.1Zr—0.1Ti (at. %) alloys at 300-400° C.," *Scrpta Materialia* 59, 387-390 (2008).

K. E. Knipling et al., "Criteria for Developing Castable, Creep-Resistant Aluminum-Based Alloys—A Review," *Z Metallkd* 97, 246-265 (2006).

K.E. Knipling et al., "Nucleation and Precipitation Strengthening in Dilute Al—Ti and Al—Zr Alloys," *Matallurgical and Materials Transactions A* 38A, 2552-2563 (2007).

K. E. Knipling et al., "Precipitation Evolution in Al—0.1Sc, Al—0.1Zr, and Al—0.1Sc—0.1Zr (at.%) Alloys during Isochronal Aging," *Acta Mater* 58, 5184-5195 (2010).

K.E. Knipling et al., "Precipitation Evolution in Al—Zr and Al—Zr—Ti Alloys during Isothermal aging at 375-425° C.," *Acta Mater* 56, 114-127 (2008).

K.E. Knipling et al., "Precipitation Evolution in Al—Zr and Al—Zr—Ti Alloys during Isothermal aging at 450-600° C.," *Acta Mater* 56, 1182-1195 (2008).

A. D. LeClaire et al., "3.2.13 Aluminum group metals," *Diffusion in Solid Metals and Alloys* (H. Mehrer (ed.)) Springer Materials—Landolt-Börnstein—Group III Condensed Matter, vol. 26, 151-156 (1990).

H. Li et al., "Precipitation Evolution and Coarsening Resistance at 400° C. of Al microalloyed with Zr and Er," *Scr Mater* 67, 73-76 (2012).

T. Ohashi et al., "Effect of Fe and Si on Age Hardening Properties of Supersaturated Solid Solution of Al—Zr Alloy by Rapid Solidification," *J Jpn. Inst Met* 34, 604-610 (1970).

T. Sato et al., "Effects of Si and Ti Addition on the Nucleation and Phase Stability of the Ll2-Type Al3Zr Phase in Al—Zr Alloys," *Mater Sci Forum*, 217-222, 895-900 (1996).

D. N. Seidman et al., "Precipitation Strengthening at Ambient and Elevated Temperatures of Heat-Treatable Al(Sc) Alloys," *Acta Mater* 50, 4021-4035 (2002).

M. E. van Dalen et al., "Effects of Ti Additions on the Nanostructure and Creep Properties of Precipitation-Strengthened Al—Sc Alloys," *Acta Mater* 53, 4225-4235 (2005).

S. P. Wen et al., "Synergetic Effect of Er and Zr on the Precipitation Hardening of Al—Er—Zr Alloy," *Scr Mater* 65, 592-595 (2011).

Y Zhang et al., "Precipitation Evolution of Al—Zr—Yb Alloys during Isochronal Aging," *Scr Mater* 69, 477-480 (2013).

* cited by examiner

ALUMINUM SUPERALLOYS FOR USE IN HIGH TEMPERATURE APPLICATIONS

TECHNICAL FIELD

The present application relates to certain aluminum alloys. More particularly, aluminum alloys are described that exhibit improved properties at elevated temperatures.

BACKGROUND

Aluminum alloys as a class are some of the most versatile engineering and construction materials available. For example, aluminum alloys are light in comparison to steel or copper and have high strength to weight ratios. Additionally, aluminum alloys resist corrosion, are up to three times more thermally conductive than steel, and can be easily fabricated into various forms. However, current commercial light-weight age-hardenable aluminum alloys are not useable above about 220° C. (428° F.) because the strengthening precipitates they contain dissolve, coarsen or transform to undesirable phases. Although aluminum-scandium alloys have been developed that can withstand higher temperatures, they are typically very expensive due to the costs associated with the use of scandium. Thus, there is a need for commercially viable uncladded aluminum alloys that have good processability characteristics and can be used in applications that are exposed to higher temperatures (e.g. 300-450° C. or 572-842° F.), such as automotive brake rotors or engine components. Cast iron, which is about three times heavier than aluminum, or titanium alloys, which are much more expensive than aluminum alloys, are commonly used for these high temperature, high stress applications.

Other potential applications for such aluminum superalloys include engine components such as pistons, where car manufacturers presently are limited to aluminum components that operate at a maximum temperature of about 220° C., therefore reducing engine efficiency, increasing emissions, and inflating the cost and mass of the cooling system. Another application is for aircraft engine structural components, such as the auxiliary power unit (APU) located in the tails of airplanes. APU frames, mounting brackets, and exhaust ducting currently use expensive titanium alloys due to the high-temperature environment of about 300° C. (572° F.), which could be replaced by lighter, much less expensive high-temperature aluminum alloys that are disclosed herein.

An inventive alloy, described herein in various embodiments, comprises aluminum, zirconium, and at least one inoculant, such as a Group 3A, 4A, and 5A metal or metalloid, and include one or more types of nanoscale $Al_3Zr$ precipitates. An alloy also can include aluminum, zirconium, a lanthanide series metal such as erbium and at least one inoculant, such as Group 3A, 4A, and 5A metals and metalloids. Such an alloy can have one or more nanoscale high number density precipitates such as $Al_3Zr$, $Al_3Er$, and $Al_3(Zr,Er)$ precipitates. The inventive alloy exhibits good strength, hardness, creep resistance and aging resistance at elevated temperatures and excellent electrical and thermal conductivity at all temperatures, while being less expensive than Sc-bearing aluminum alloys.

SUMMARY OF INVENTION

This application is directed to, inter alia, aluminum-zirconium and aluminum-zirconium-lanthanide superalloys that can be used in high temperature, high stress and a variety of other applications. The lanthanide is preferably holmium, erbium, thulium or ytterbium, most preferably erbium. Also, methods of making the aforementioned alloys are disclosed. The superalloys, which have commercially-suitable hardness at temperatures above about 220° C., include nanoscale $Al_3Zr$ precipitates and optionally nanoscale $Al_3Er$ precipitates and nanoscale $Al_3(Zr,Er)$ precipitates that create a high-strength alloy capable of withstanding intense heat conditions. These nanoscale precipitates have a $L1_2$-structure in α-Al(f.c.c.) matrix, an average diameter of less than about 20 nanometers ("nm"), preferably less than about 10 nm, and more preferably about 4-6 nm and a high number density, which for example is larger than about $10^{21}$ $m^{-3}$, of the nanoscale precipitates. Additionally, methods for increasing the diffusivity of Zr in Al are disclosed.

A first embodiment of the invention is directed to an alloy of aluminum (including any unavoidable impurities) alloyed with zirconium, and one or more of the following elements: tin, indium, antimony, and magnesium, the alloy including a plurality of nanoscale $Al_3Zr$ precipitates having a $L1_2$-structure.

A second embodiment of the invention is directed to an alloy of aluminum (including any unavoidable impurities) alloyed with zirconium, erbium and one or more of the following elements: silicon, tin, indium, antimony, and magnesium, the alloy including a plurality of nanoscale $Al_3Zr$ precipitates, nanoscale $Al_3Er$ precipitates, and nanoscale $Al_3(Zr,Er)$ precipitates having a $L1_2$-structure.

A third embodiment of the invention is directed to an alloy of aluminum (including any unavoidable impurities) alloyed with zirconium and a combination of any two, three, four, or all five of the following elements: silicon, tin, indium, antimony and magnesium, the alloy including a plurality of nanoscale $Al_3Zr$ precipitates having a $L1_2$-structure.

A fourth embodiment of the invention is directed to an alloy of aluminum (including any unavoidable impurities) alloyed with zirconium, a lanthanide series metal preferably holmium, erbium, thulium or ytterbium, most preferably erbium, and a combination of any two, three, four, or all five of the following elements: silicon, tin, indium, antimony and magnesium, the alloy including a plurality of nanoscale $Al_3Zr$ precipitates, nanoscale $Al_3X$ precipitates and nanoscale $Al_3(Zr,X)$ precipitates having a $L1_2$-structure, where X is a lanthanide series metal.

A fifth embodiment is directed to an alloy of about 0.3 atomic percent ("at. %") Zr (all concentrations herein are given in atomic percent unless otherwise indicated), about 1.5 at. % Si, about 0.1 at. % Sn, about 0.1 at. % In, about 0.1 at. % Sb, the balance being aluminum and any unavoidable impurities, the alloy further including a plurality of nanoscale $Al_3Zr$ precipitates having a $L1_2$-structure.

A sixth embodiment is directed to an alloy of about 0.1 at. % Zr, about 0.01 at. % Sn, and the balance being aluminum and any unavoidable impurities, the alloy including a plurality of nanoscale $Al_3Zr$ precipitates having a $L1_2$-structure.

A seventh embodiment is directed to an alloy of about 0.1 at. % Zr, about 0.02 at. % Sn, and the balance being aluminum and any unavoidable impurities, the alloy including a plurality of nanoscale $Al_3Zr$ precipitates having a $L1_2$-structure.

An eighth embodiment is directed to an alloy of about 0.06 at. % Zr, about 0.02 at. % In, and the balance being aluminum and any unavoidable impurities, the alloy including a plurality of nanoscale $Al_3Zr$ precipitates having a $L1_2$-structure.

A ninth embodiment is directed to an alloy of about 0.3 at. % Zr, about 0.05 at. % Er, about 1.5 at. % Si, about 0.1 at.

% Sn, about 0.1 at. % In, about 0.1 at. % Sb, and the balance being aluminum and any unavoidable impurities, the alloy including a plurality of nanoscale $Al_3Zr$ precipitates, nanoscale $Al_3Er$ precipitates, and nanoscale $Al_3(Zr,Er)$ precipitates having a $L1_2$-structure.

A tenth embodiment is directed to an alloy of about 0.1 at. % Zr, about 0.04 at. % Er, about 0.01 at. % Sn, and the balance being aluminum and any unavoidable impurities, the alloy including a plurality of nanoscale $Al_3Zr$ precipitates, nanoscale $Al_3Er$ precipitates, and nanoscale $Al_3(Zr,Er)$ precipitates having a $L1_2$-structure.

An eleventh embodiment is directed to an alloy of about 0.1 at. % Zr, about 0.04 at. % Er, about 0.02 at. % Sn, and the balance being aluminum and any unavoidable impurities, the alloy including a plurality of nanoscale $Al_3Zr$ precipitates, nanoscale $Al_3Er$ precipitates, and nanoscale $Al_3(Zr,Er)$ precipitates having a $L1_2$-structure.

A twelfth embodiment comprises an alloy of about 0.1 at. % Zr, about 0.04 at. % Er, about 0.2 at. % Si, and the balance being aluminum and any unavoidable impurities, the alloy including a plurality of nanoscale $Al_3Zr$ precipitates, nanoscale $Al_3Er$ precipitates, and nanoscale $Al_3(Zr,Er)$ precipitates having a $L1_2$-structure.

A thirteenth embodiment is directed to an alloy of about 0.1 at. % Zr, about 0.04 at. % Er, about 0.02 at. % In, and the balance being aluminum and any unavoidable impurities, the alloy including a plurality of nanoscale $Al_3Zr$ precipitates, nanoscale $Al_3Er$ precipitates, and nanoscale $Al_3(Zr,Er)$ precipitates having a $L1_2$-structure.

A fourteenth embodiment is directed to an alloy of about 0.1 at. % Zr, about 0.04 at. % Er, about 0.02 at. % antimony, and the balance being aluminum and any unavoidable impurities, the alloy including a plurality of nanoscale $Al_3Zr$ precipitates, nanoscale $Al_3Er$ precipitates, and nanoscale $Al_3(Zr,Er)$ precipitates having a $L1_2$-structure.

A fifteenth embodiment is directed to an alloy of Al—Zr—X—Si—Mg, wherein Si and Mg are alloying elements and X can be a Group 3A metal or metalloid, the alloy including a plurality of nanoscale $Al_3Zr$ precipitates having a $L1_2$-structure. Alloying elements are understood to be elements typically present in commercial aluminum alloys such as 1000 to 8000 series alloys, for example.

A sixteenth embodiment is directed to an alloy of Al—Zr—X—Si—Mg, wherein Si and Mg are alloying elements and X is a Group 4A metal or metalloid, the alloy including a plurality of nanoscale $Al_3Zr$ precipitates having a $L1_2$-structure.

A seventeenth embodiment is directed to an alloy of Al—Zr—X—Si—Mg, wherein Si and Mg are alloying elements and X can be a Group 5A metal or metalloid, the alloy including a plurality of nanoscale $Al_3Zr$ precipitates having a $L1_2$-structure.

An eighteenth embodiment is directed to an alloy of Al—Zr—Er—X—Si—Mg, wherein Si and Mg are alloying elements and X is a Group 3A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A nineteenth embodiment is directed to an alloy of Al—Zr—Er—X—Si—Mg, wherein Si and Mg are alloying elements and X is a Group 4A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A twentieth embodiment is directed to an alloy of Al—Zr—Er—X—Si—Mg, wherein Si and Mg are alloying elements and X is a Group 5A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A twenty-first embodiment is directed to an alloy of Al—Zr—X—Fe, wherein Fe is an alloying element and X can be a Group 3A metal or metalloid, the alloy including a plurality of nanoscale $Al_3Zr$ precipitates having a $L1_2$-structure.

A twenty-second embodiment is directed to an alloy of Al—Zr—X—Fe, wherein Fe is an alloying element and X is a Group 4A metal or metalloid, the alloy including a plurality of nanoscale $Al_3Zr$ precipitates having a $L1_2$-structure.

A twenty-third embodiment is directed to an alloy of Al—Zr—X—Fe, wherein Fe is an alloying element and X can be a Group 5A metal or metalloid, the alloy including a plurality of nanoscale $Al_3Zr$ precipitates having a $L1_2$-structure.

A twenty-fourth embodiment is directed to an alloy of Al—Zr—Er—X—Fe, wherein Fe is an alloying element and X is a Group 3A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A twenty-fifth embodiment is directed to an alloy of Al—Zr—Er—X—Fe, wherein Fe is an alloying element and X is a Group 4A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A twenty-sixth embodiment is directed to an alloy of Al—Zr—Er—X—Fe, wherein Fe is an alloying element and X is a Group 5A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A twenty-seventh embodiment is directed to an alloy of Al—Zr—X—Mg, wherein Mg is an alloying element and X can be a Group 3A metal or metalloid, the alloy including a plurality of nanoscale $Al_3Zr$ precipitates having a $L1_2$-structure.

A twenty-eighth embodiment is directed to an alloy of Al—Zr—X—Mg, wherein Mg is an alloying element and X is a Group 4A metal or metalloid, the alloy including a plurality of nanoscale $Al_3Zr$ precipitates having a $L1_2$-structure.

A twenty-nineth embodiment is directed to an alloy of Al—Zr—X—Mg, wherein Mg is an alloying element and X can be a Group 5A metal or metalloid, the alloy including a plurality of nanoscale $Al_3Zr$ precipitates having a $L1_2$-structure.

A thirtieth embodiment is directed to an alloy of Al—Zr—Er—X—Mg, wherein Mg is an alloying element and X is a Group 3A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A thirty-first embodiment is directed to an alloy of Al—Zr—Er—X—Mg, wherein Mg is an alloying element and X is a Group 4A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A thirty-second embodiment is directed to an alloy of Al—Zr—Er—X—Mg, wherein Mg is an alloying element and X is a Group 5A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A thirty-third embodiment is directed to an alloy of Al—Zr—X—Cu, wherein Cu is an alloying element and X can be a Group 3A metal or metalloid, the alloy including a plurality of nanoscale $Al_3Zr$ precipitates having a $L1_2$-structure.

A thirty-fourth embodiment is directed to an alloy of Al—Zr—X—Cu, wherein Cu is an alloying element and X is a Group 4A metal or metalloid, the alloy including a plurality of nanoscale $Al_3Zr$ precipitates having a $L1_2$-structure.

A thirty-fifth embodiment is directed to an alloy of Al—Zr—X—Cu, wherein Cu is an alloying element and X can be a Group 5A metal or metalloid, the alloy including a plurality of nanoscale $Al_3Zr$ precipitates having a $L1_2$-structure.

A thirty-sixth embodiment is directed to an alloy of Al—Zr—Er—X—Cu, wherein Cu is an alloying element and X is a Group 3A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A thirty-seventh embodiment is directed to an alloy of Al—Zr—Er—X—Cu, wherein Cu is an alloying element and X is a Group 4A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A thirty-eighth embodiment is directed to an alloy of Al—Zr—Er—X—Cu, wherein Cu is an alloying element and X is a Group 5A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A twenty-ninth embodiment is directed to an alloy of Al—Zr—X—Si, wherein Si is an alloying element and X can be a Group 3A metal or metalloid, the alloy including a plurality of nanoscale $Al_3Zr$ precipitates having a $L1_2$-structure.

A fortieth embodiment is directed to an alloy of Al—Zr—X—Si, wherein Si is an alloying element and X is a Group 4A metal or metalloid, the alloy including a plurality of nanoscale $Al_3Zr$ precipitates having a $L1_2$-structure.

A forty-first embodiment is directed to an alloy of Al—Zr—X—Si, wherein Si is an alloying element and X can be a Group 5A metal or metalloid, the alloy including a plurality of nanoscale $Al_3Zr$ precipitates having a $L1_2$-structure.

A forty-second embodiment is directed to an alloy of Al—Zr—Er—X—Si, wherein Si is an alloying element and X is a Group 3A metal or metalloid, the alloy including a plurality of nano scale $Al_3Zr$ precipitates, nanoscale $Al_3Er$ precipitates, and nanoscale $Al_3(Zr,Er)$ precipitates having a $L1_2$-structure.

A forty-third embodiment is directed to an alloy of Al—Zr—Er—X—Si, wherein Si is an alloying element and X is a Group 4A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A forty-fourth embodiment is directed to an alloy of Al—Zr—Er—X—Si, wherein Si is an alloying element and X is a Group 5A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A forty-fifth embodiment is directed to an alloy of Al—Zr—X—Zn—Mg, wherein Zn and Mg are alloying elements and X can be a Group 3A metal or metalloid, the alloy including a plurality of nanoscale $Al_3Zr$ precipitates having a $L1_2$-structure.

A forty-sixth embodiment is directed to an alloy of Al—Zr—X—Zn—Mg, wherein Zn and Mg are alloying elements and X is a Group 4A metal or metalloid, the alloy including a plurality of nanoscale $Al_3Zr$ precipitates having a $L1_2$-structure.

A forty-seventh embodiment is directed to an alloy of Al—Zr—X—Zn—Mg, wherein Zn and Mg are alloying elements and X can be a Group 5A metal or metalloid, the alloy including a plurality of nanoscale $Al_3Zr$ precipitates having a $L1_2$-structure.

An forty-eighth embodiment is directed to an alloy of Al—Zr—Er—X—Zn—Mg, wherein Zn and Mg are alloying elements and X is a Group 3A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A forty-nineth embodiment is directed to an alloy of Al—Zr—Er—X—Zn—Mg, wherein Zn and Mg are alloying elements and X is a Group 4A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A fiftieth embodiment is directed to an alloy of Al—Zr—Er—X—Zn—Mg, wherein Zn and Mg are alloying elements and X is a Group 5A metal or metalloid, the alloy including a plurality of nanoscale $Al_3Zr$ precipitates, nanoscale $Al_3Er$ precipitates, and nanoscale $Al_3(Zr,Er)$ precipitates having a $L1_2$-structure.

A fifty-first embodiment of the invention is directed to an alloy of aluminum, zirconium, and one or more of the following elements: tin, indium and antimony, the alloy being essentially scandium free and including a plurality of nanoscale $Al_3Zr$ precipitates having a $L1_2$-structure.

A fifty-second embodiment of the invention is directed to an alloy of aluminum, zirconium, erbium and one or more of the following elements: silicon, tin, indium and antimony, the alloy being essentially scandium-free and including a plurality of nanoscale $Al_3Zr$ precipitates, nanoscale $Al_3Er$ precipitates, and nanoscale $Al_3(Zr,Er)$ precipitates having a $L1_2$-structure.

In another aspect of the invention, the $Al_3Zr$ precipitates and/or nanoscale $Al_3Er$ precipitates and/or nanoscale $Al_3(Zr,Er)$ precipitates are less than about 10 nm in average diameter. In another aspect of the invention, the $Al_3Zr$ precipitates and/or nanoscale $Al_3Er$ precipitates are about 4-6 nm in average diameter.

In another aspect of the invention, disclosed is a method of forming an essentially scandium-free aluminum alloy having a plurality of nanoscale precipitates having a $L1_2$-structure that are selected from the group consisting of $Al_3Zr$, $Al_3Er$ and $Al_3(Zr,Er)L1_2$. The method may include the following steps: (a) making a melt of aluminum and an addition of zirconium, and one or more of erbium, silicon, tin, indium, antimony, and magnesium; (b) solidifying the melt and cooling the resulting solid piece to a temperature of about 0° C. (32° F.) to about 300° C. (572° F.); (c) optionally homogenizing the solid piece at a temperature of about 600° C. (1112° F.) to about 660° C. (1220° F.) (e.g., 640° C. or 1184° F.) for about 0.3 hour to about 72 hours; (d) optionally performing a first heat-treating step to precipitate some of the alloying elements, which includes maintaining a temperature of about 100° C. (212° F.) to about 375° C. (707° F.) for about 1 to about 12 hours; and (e) after the first optional heat-treating step, performing a main heat treating step that comprises heating and maintaining a temperature of about 375° C. (707° F.) to about 550° C. (1022° F.) for about 1 hour to 48 hours.

In another aspect of the invention, disclosed is a method of forming an essentially scandium-free aluminum alloy having a plurality of nanoscale $Al_3Zr$ precipitates or nanoscale $Al_3Zr$ precipitates, nanoscale $Al_3Er$ precipitates, and nanoscale $Al_3(Zr,Er)$ precipitates having a $L1_2$-structure. The method may include the following steps: (a) making a melt of aluminum and an addition of zirconium, and one or more of erbium, silicon, tin, indium, antimony, and magnesium; (b) solidifying the melt and cooling the resulting solid piece to a temperature of about 0° C. (32° F.) to about 300° C. (572° F.); (c) optionally homogenizing the solid piece at a temperature of about 600° C. (1112° F.) to about 660° C. (1220° F.) (e.g., 640° C. or 1184° F.) for about 0.3 hour to about 72 hours; (d) performing a first heat-treating step by maintaining a temperature of about 100° C. (212° F.) to about 375° C. (707° F.) for about 1 hour to about 12 hours; and (e) performing a second heat-treating step maintaining a temperature of about 375° C. (707° F.) to about 550° C. (1022° F.) for about 1 hour to 48 hours.

Additional details and aspects of the disclosed aluminum alloys and methods of making will be described in the following description, including drawings.

BRIEF DESCRIPTION OF DRAWINGS

FIG. 9 also includes a magnified reconstruction of a pair of nanoprecipitates, exhibiting Zr atoms (green) and Sn atoms (red). 12 at. % Zr was used as isoconcentration surface in the analysis to differentiate the precipitates from the matrix.

DETAILED DESCRIPTION OF INVENTION

It should be understood that the present disclosure is to be considered as an exemplification of the present invention, which has multiple embodiments, and is not intended to limit the invention to the specific embodiments illustrated. It should be further understood that the title of this section of this application ("Detailed Description of the Invention") relates to a requirement of the United States Patent Office, and should not be found to limit the subject matter disclosed herein.

Novel aluminum based superalloys are disclosed. The alloys comprise aluminum, zirconium and at least one inoculant, and include nanoscale $Al_3Zr$ precipitates. Also disclosed are alloys that comprise aluminum, zirconium, a lanthanide preferably holmium, erbium, thulium or ytterbium, most preferably erbium, and at least one inoculant, and include nanoscale $Al_3Zr$ precipitates, nanoscale $Al_3$ lanthanide precipitates, and $Al_3$(Zr,lanthanide) precipitates. These superalloys are readily processable and have high heat resistance, especially at about 300-450° C. (572-842° F.). Further, a method for increasing the diffusivity of zirconium in aluminum by using a Group 3A, Group 4A or Group 5A metal or metalloid as an inoculant is disclosed. Also, a method for decreasing the precipitate diameter of $Al_3Zr$ ($L1_2$) precipitates by the use of an inoculant is described. Inoculants such as Group 3A, 4A, and 5A metals or metalloids are provided in sufficient amounts to provide for the formation of the high number density of nanoscale precipitates, and includes the amounts described in the Examples and Figures.

Figure 1:
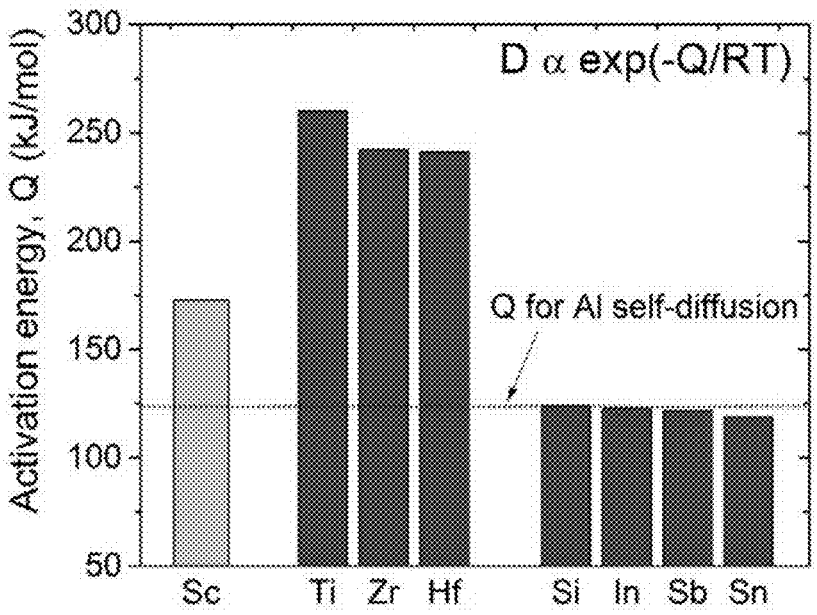
FIG. 1 is graphical illustration of measured activation energies for diffusion of solutes in α-Al matrix, which scales with the relative diffusivities of Sc, Group 4B elements (Ti, Zr, and Hf) and some selected inoculants.

A contemplated aluminum alloy also can be essentially scandium-free (meaning that scandium (Sc) is present in a range of less than about 0.04 at. % to about 0.00 at. % of the alloy), while displaying the same or improved mechanical properties at ambient and elevated temperatures when compared to scandium-containing aluminum alloys. The conventional wisdom is that the elimination of Sc in the alloy is unlikely to succeed, because, for example, no other elements possess the same thermodynamic and kinetic properties as Sc in the α-Al matrix, including eutectic (rather than peritectic) solidification, relatively high solubility in solid aluminum near the melting point, said solubility decreasing to near zero values at about 200° C. (392° F.), ability to create coherent and semi-coherent $Al_3X$ precipitates, wherein X is a metal, having ($L1_2$ structure) with high resistance to shearing, with low coarsening rate tendency and with a small lattice parameter mismatch with Al, diffusivities small enough to prevent coarsening, but fast enough to permit homogenization, high corrosion and oxidation resistance after dissolution, low density, sufficiently low melting point to allow for rapid dissolution in liquid aluminum. For example, as illustrated in FIG. 1, diffusivity of zirconium in aluminum is two to three orders of magnitude slower than Sc. Because of this small diffusivity, dilute Al—Zr alloys cannot be strengthened by a high number density of nanoscale $Al_3Zr(L1_2)$ precipitates during aging at low temperatures where the chemical driving force for nucleation is very high.

Figure 2A:
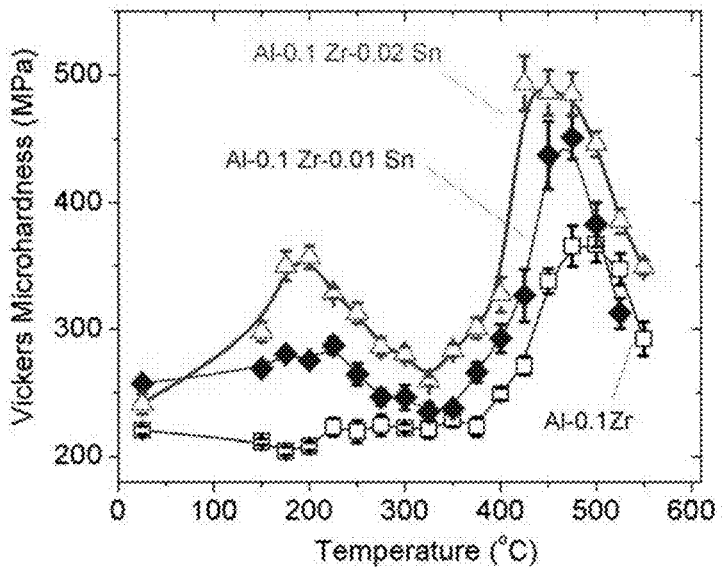
FIGS. 2A and 2B displays the temporal evolution of the Vickers microhardness, FIG. 2A, and electrical conductivity at room temperature, FIG. 2B, during isochronal aging in steps of 25° C./3 hours for Al-0.1 Zr at. %, Al-0.1 Zr-0.01 Sn at. %, and Al-0.1 Zr-0.02 Sn at. %, after homogenization at 640° C. (1184° F.) for 24 hours.
Figure 3A:
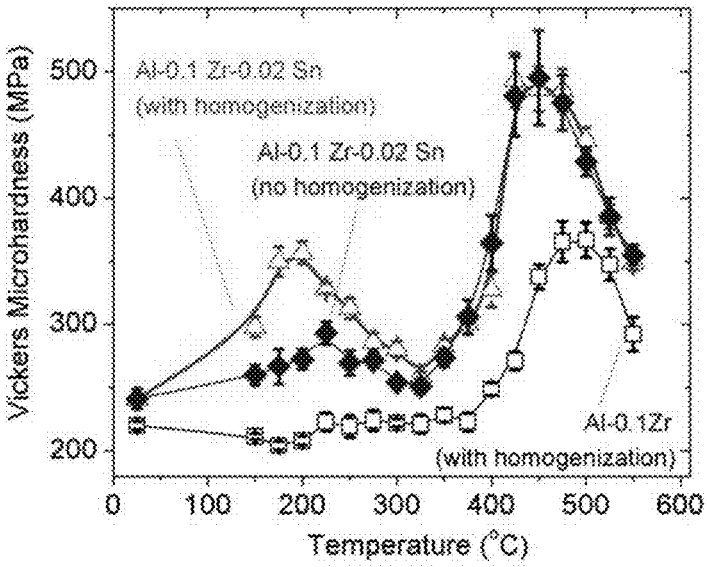
FIGS. 3A and 3B show the temporal evolution of the Vickers microhardness, FIG. 3A, and electrical conductivity at room temperature, FIG. 3B, during isochronal aging in steps of 25° C./3 hours for Al-0.1 Zr-0.02 Sn at. %, after either homogenization at 640° C. (1184° F.) for 24 hours or without homogenization, e.g., as-cast. Data for Al-0.1 Zr at. % alloy are also included for comparison.
Figure 4A:
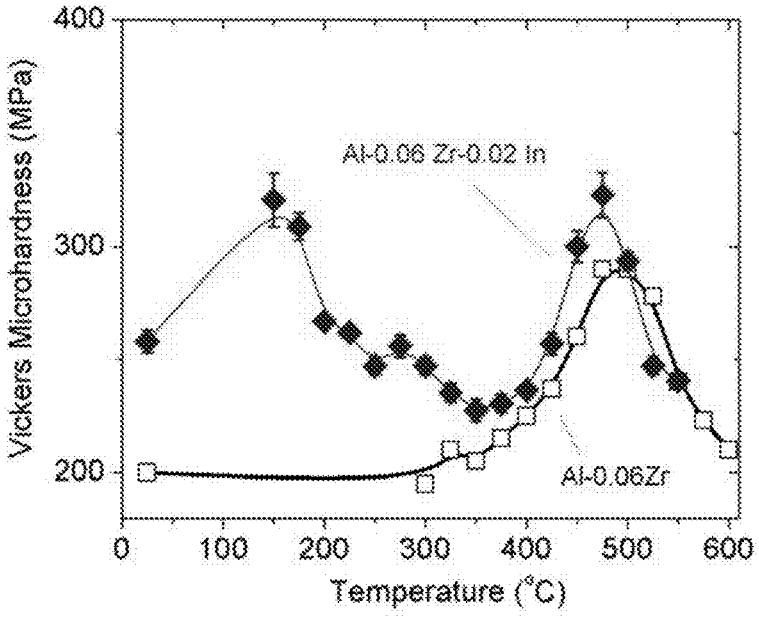
FIGS. 4A and 4B show the temporal evolution of the Vickers microhardness, FIG. 4A, and electrical conductivity at room temperature, FIG. 4B, during isochronal aging in steps of 25° C./3 hours for Al-0.06 Zr at. % without homogenization and Al-0.06 Zr-0.02 In at. % after homogenization at 640° C. (1184° F.) for 24 hours.

FIGS. 2A, 3A and 4A show that for the binary Al-0.06 Zr and Al-0.1 Zr, precipitation occurs at high temperatures (the peak hardness is at about 500° C.), leading to relatively low peak microhardness. This is because $Al_3Zr$ precipitates, which are responsible for the microhardness increase, form with relatively large sizes of 20 nm to 200 nm, because the supersaturation is smaller and diffusion is faster at the higher temperature.

It is thus desirable to add an inoculant that shifts the temperature of precipitation to lower temperatures by increasing the diffusivity of Zr in Al, thus increasing the supersaturation of Zr in Al. In such alloys, aging at a temperature of about 200° C. (392° F.) to about 400° C. (752° F.) creates smaller precipitates with higher volume fractions, which are thus more effective strengtheners. Zirconium, however, diffuses very slowly in that range of temperature, and thus does not nucleate small precipitates, with diameters smaller than 20 nm, in aluminum. During artificial aging at a higher temperatures of about 400° C. (752° F.) to about 600° C. (1112° F.), or during cooling to a solid mass from a melt, $Al_3Zr$ precipitates can be formed, but with relatively large diameters of about 20 nm to about 200 nm Therefore, an aluminum alloy, containing only zirconium typically is unsatisfactory in forming a high-strength alloy.

Figure 9:
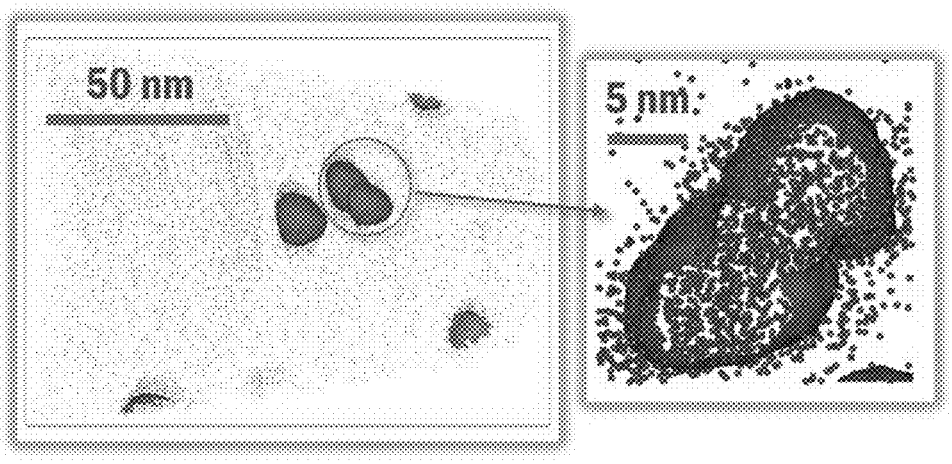
FIG. 9 is a 3-D atom-probe tomographic reconstruction of the Al-0.1 Zr-0.02 Sn at. %, after homogenization at 640° C. (1184° F.) for 24 hours, then being aged at 400° C. (752° F.) for 72 hours, showing the $Al_3Zr$ nano-precipitates with a diameter of about 8-12 nm.

It has been discovered that the presence of one or more of the following elements: tin, indium, and antimony, in an aluminum-zirconium alloy can create a high-strength alloy. Silicon also can be used in conjunction with one or more of these elements. It is believed that atoms of tin, indium, and antimony bind with zirconium atoms to provide for faster diffusion of zirconium in aluminum. Thereafter, smaller $Al_3Zr$ precipitates can be created during artificial aging at lower temperatures, of about 300° C. (572° F.) to about 400° C. (752° F.), as compared to Al—Zr alloys free of an inoculant. These nanoscale precipitates form and have average diameters that are less than about 20 nm and preferably less than about 10 nm, and more preferably about 4-6 nm. An example is shown in FIG. 9, a 3-D atom-probe tomographic reconstruction of the Al-0.1 Zr-0.02 Sn at. %, after homogenization at 640° C. (1184° F.) for 24 hours, then being aged at 400° C. (752° F.) for 72 hours, showing the $Al_3Zr$ nano-precipitates with an average diameter of about 8-12 nm.

Therefore, an aluminum alloy comprising zirconium with one or more of the following inoculants, tin, indium and antimony, and optionally also including silicon, which will create a higher-strength alloy than without inoculants is disclosed.

It also has been discovered that the addition of erbium in an aluminum-zirconium alloy, further comprising one or more of the following elements, tin, indium and antimony, and optionally also including silicon, can create a high number density of $Al_3Er$ precipitates during artificial aging at a lower temperature of about 200° C. (572° F.) to about 350° C. (662° F.). These alloys also precipitate $Al_3Zr$ precipitates at temperatures of about 350° C. (662° F.) to about 550° C. (1022° F.), like those alloys without Er, as well as $Al_3(Zr,Er)$ precipitates. The nanoscale $Al_3Er$ precipitates, nanoscale $Al_3Zr$ precipitates, and nanoscale $Al_3(Zr,Er)$ precipitates create a combined matrix that displays an improvement in strength compared to an $Al_3Zr$ alloy with no addition of erbium.

EXAMPLES

The following examples are set forth to aid in the understanding of the invention, and should not be construed to limit in any way the invention as defined in the claims that follow thereafter.

Alloys 1-4

Alloy Composition, Processing and Analytical Techniques

One binary control alloy and three ternary inoculated alloys were cast with a nominal composition, in atomic percent, at. %, of Al-0.1 Zr, Al-0.1 Zr-0.01 Sn, Al-0.1 Zr-0.02 Sn, Al-0.06 Zr-0.02 In. Master alloys, including 99.99 wt. % pure Al, Al-5.0 Zr wt. %, 99.99 wt. % pure Sn, and 99.99 wt. % pure In, were melted in alumina crucibles in air. The melt was held for 60 minutes at 800° C., stirred vigorously, and then cast into a graphite mold, which was optionally preheated to 200° C. The mold was placed on an ice-cooled copper platen during solidification to enhance directional solidification and decrease formation of shrinkage cavities. The alloy's chemical composition was measured by direct-current plasma atomic-emission spectroscopy (DCP-AES).

TABLE 1

| Alloy | Nominal Composition, at. % | Measured Composition, at. % (DCP-AES) |
|---|---|---|
| 1 | A1-0.1 Zr | A1-0.098 Zr |
| 2 | A1-0.1 Zr-0.01 Sn | A1-0.086 Zr-0.008 Sn |
| 3 | A1-0.1 Zr-0.02 Sn | A1-0.113 Zr-0.019 Sn |
| 4 | A1-0.06 Zr-0.02 In | A1-0.062 Zr-0.028 In |

The cast alloys were homogenized in air at about 640° C. for 24 hours ("h"), then water quenched to ambient temperature. Isochronal aging in 3 hour steps of 25° C. for temperatures of about 150° C. to about 550° C. was conducted. All heat treatments were conducted in air and terminated by water quenching to ambient temperature.

Vickers microhardness measurements were performed with a Duramin-5 microhardness tester (Struers) using a 200 g load applied for 5 seconds(s) on samples polished to a 1 μm surface finish. At least ten indentations across different grains were made per specimen. Electrical conductivity measurements were performed at room temperature using a Sigmatest 2.069 eddy current instrument. Five measurements at 120, 240, 480, and 960 kHz were performed per specimen.

Isochronal Aging Heat Treatment

Figure 2B:
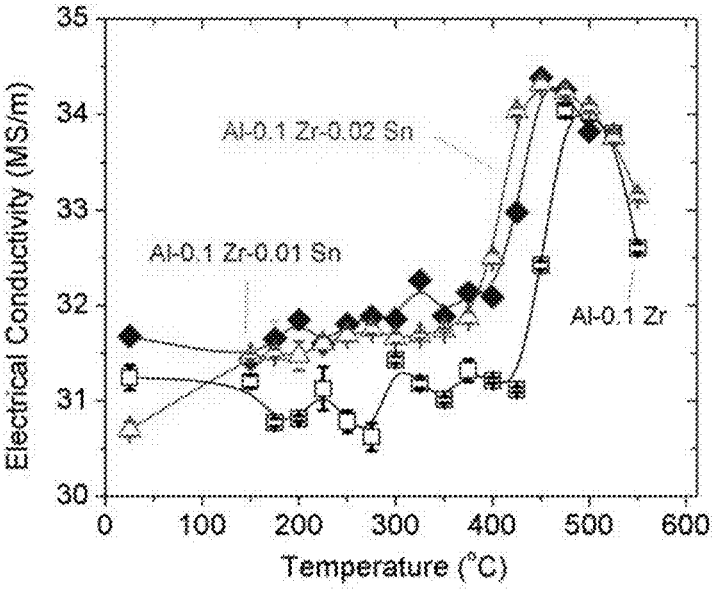

Microhardness and electrical conductivity temporal evolutions of Alloys 1-3 during isochronal aging treatment in stages of 25° C./3 hours, following homogenization at 640° C. for 24 hours, are shown in FIGS. 2A and 2B. In the Al-0.1 Zr control alloy, microhardness commences to increase at 400° C., peaking at about 500° C. with a peak-microhardness of 367+14 MPa. The microhardness peak is due to formation of $Al_3Zr$ precipitates, which are—relatively large in diameter (>20 nm). The microhardness continuously decreases beyond aging temperature of 500° C. due to precipitates both coarsening and dissolving back into the matrix.

In the Al-0.1 Zr-0.01 Sn alloy, microhardness commences to increase at 150° C., peaking at about 225° C. for the first time with a microhardness of 287±6 MPa. It then decreases at higher temperatures, but increases again at 375° C., peaking at about 475° C. for the second time with a microhardness of 451±17 MPa. The microhardness continuously decreases beyond an aging temperature of 475° C. Al-0.1 Zr-0.02 Sn behaves similarly to the Al-0.1 Zr-0.01 Sn alloy, except that its first microhardness peak is at a lower temperature of 200° C. with a higher value of 357±9 MPa, and its second microhardness peak is at a lower temperature of 425° C. and a higher value of 493±22 MPa. It is noted that the first peak-microhardness value of Al-0.1 Zr-0.02 Sn, occurring at 200° C. is the same as the peak-microhardness value of Al-0.1 Zr alloy, occurring at 500° C. It is also noted that the addition of 0.01-0.02 at. % of Sn improves peak-microhardness of Al-0.1 Zr from 367 to 451 and 493 MPa, respectively, while decreasing peak temperature. The larger obtained peak-microhardness values in Sn-containing alloys are believed to be due to the formation of smaller nanoscale precipitates with diameters smaller than 10 nm With the same precipitate volume fraction, a distribution of smaller precipitates proved more effective in strengthening the alloy as compared to an alloy composed of coarser precipitates.

The temporal evolution of the electrical conductivity of Alloys 1-3 are shown in FIG. 2B. The electrical conductivity of the Al-0.1 Zr alloy is 31.24±0.13 MS/m in the homogenized state. It commences to increase at 425° C., peaking at 475° C. with the value 34.03±0.06 MS/m, which is 58.7% of the International Annealed Copper Standard (IACS). The increase in electrical conductivity is due to precipitation of the $Al_3Zr$ phase, which removes Zr solute atoms from the Al matrix. The conductivity decreases continuously at higher temperatures, as $Al_3Zr$ precipitates dissolve and Zr atoms dissolve in the Al matrix. The electrical conductivity evolves temporally for Al-0.1 Zr-0.01 Sn and Al-0.1 Zr-0.02 Sn, which are similar to Al-0.1 Zr alloy, except that their electrical conductivity values commence to increase at lower temperatures, 400° C. and 375° C., respectively. They also peak at lower temperatures, both at 450° C., and at larger values of 34.38±0.06 MS/m (59.3% IACS) and 34.31±0.06 MS/m (59.2% IACS for Al-0.1 Zr-0.01 Sn and Al-0.1 Zr-0.02 Sn alloy, respectively.

Figure 3B:
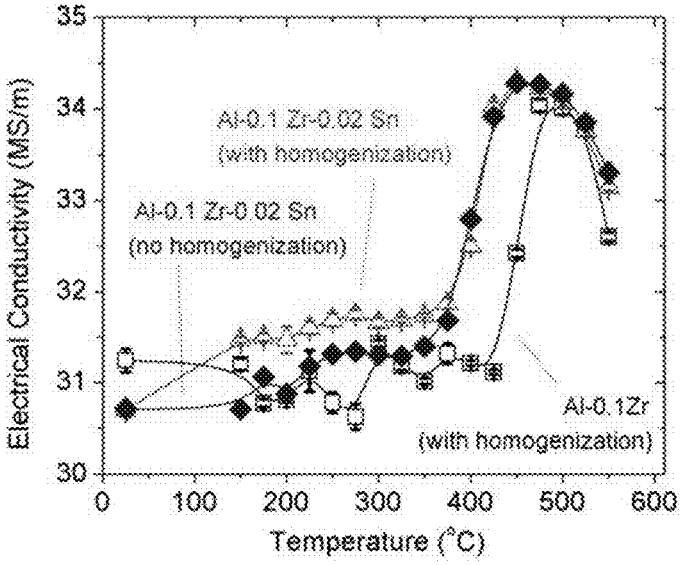

In alloy 3, Al-0.1 Zr-0.02 Sn, FIGS. 3A and 3B show the temporal evolution of the microhardness and electrical conductivity, respectively, both for as-cast and homogenized states (640° C. for 24 hours), during isochronal aging treatment in stages of 25° C./3 hours. They both behave similarly, except for the first microhardness peak, where the as-cast alloy first peaks at 225° C. with the value 293±9 MPa and the homogenized alloy first peaks 200° C. with the value of 357±9 MPa. The temporal evolution of the electrical conductivity-of the two alloys behave similarly.

Figure 4B:
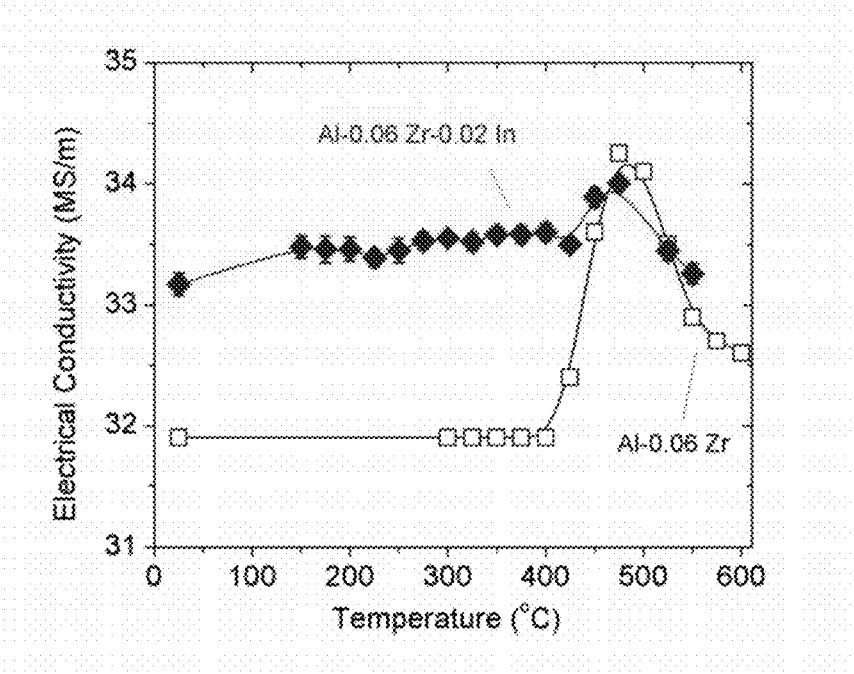

FIGS. 4A and 4B show the temporal evolution of the microhardness and electrical conductivity, respectively, of as-cast Al-0.06 Zr without homogenization and homogenized Al-0.06 Zr-0.02 In alloy during isochronal aging treatment in stages of 25° C./3 hours. In the Al-0.06 Zr alloy, the microhardness commences to increase at 400° C., peaking at about 490° C. with a peak-microhardness of 290 MPa. The microhardness peaks, again, due to formation of $Al_3Zr$ precipitates. In the Al-0.06 Zr-0.02 In alloy, the microhardness commences to increase below 150° C., peaking at about 150° C. for the first time with a microhardness of 321±12 MPa, which is greater than the peak for the Al-0.06 Zr alloy. It then decreases at higher temperatures, but increases again at 400° C., peaking at 475° C. for a second time with the microhardness of 323±10 MPa, which is again greater than the peak microhardness for the Al-0.06 Zr alloy. The microhardness decreases continuously beyond the aging temperature of 475° C. The electrical conductivity of the Al-0.06 Zr alloy is 31.9 MS/m in the as-cast state. It commences to increase at 425° C., peaking at 475° C. with a value of 34.25 MS/m (59.1% IACS). The electrical conductivity of the Al-0.06 Zr-0.02 In alloy is 33.17±0.09 MS/m at the homogenized state. It increases slightly below 150° C., saturates at higher temperatures, increases again at 425° C., peaks at 475° C. with the value 34.00±0.05 MS/m (58.6% IACS).

The data show that the addition of 0.01-0.02 at. % Sn as an inoculant provides improved microhardness, thus mechanical strength, electrical conductivity, and possibly thermal conductivity, in the Al-0.1 Zr alloy. An addition of 200 ppm In as an inoculant improves microhardness, thus mechanical strength, and slightly decreases electrical conductivity. The inoculants facilitate formation of nanosized precipitates at lower temperatures and create high-strength alloys with precipitates that are less than 20 nm in diameter and are usually less than about 10 nm in diameter.

Figure 8A:
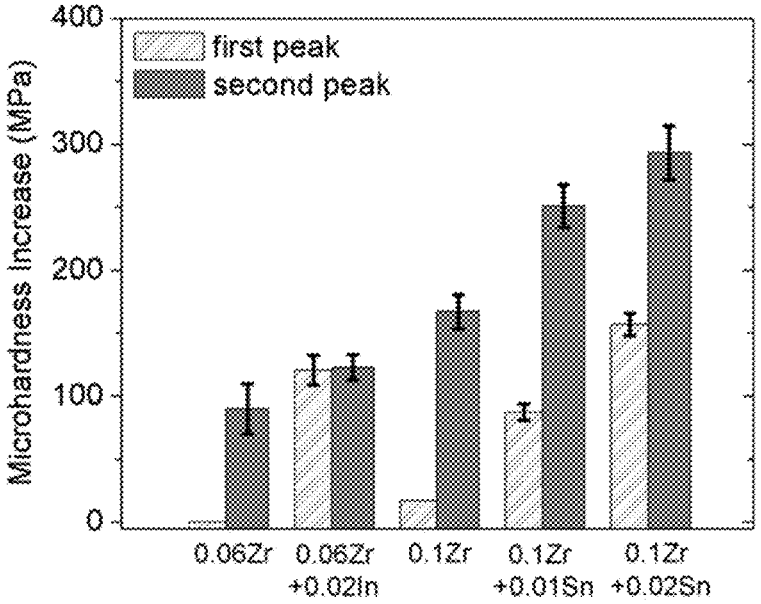
FIG. 8A is a summary illustration of the microhardness increases, from the base value of 200 MPa, of the first and second peak-hardness, during isochronal aging in steps of 25° C./3 hours for Al-0.06 Zr at. %, Al-0.06 Zr-0.02 In at. %, Al-0.1 Zr at. %, Al-0.1 Zr-0.01 Sn at. %, Al-0.1 Zr-0.02 Sn at. %, after homogenization at 640° C. (1184° F.) for 24 hours.

FIG. 8A is a summary illustration of the microhardness increases, from the base value of 200 MPa, of the first and second peak-microhardness, during isochronal aging in steps of 25° C./3 hours for all Al-0.06 Zr-based and Al-0.1 Zr-based alloys.

Alloys 5-10

Alloy Composition, Processing and Analytical Techniques

One ternary and five quaternary alloys were cast with a nominal composition, in atomic percent, at. %, of Al-0.1 Zr-0.04 Er, Al-0.1 Zr-0.04 Er-0.17 Si, Al-0.1 Zr-0.04 Er-0.01 Sn, Al-0.1 Zr-0.04 Er-0.02 Sn, Al-0.1 Zr-0.04 Er-0.02 In, Al-0.1 Zr-0.04 Er-0.02 Sb. Master alloys, including 99.99 wt. % pure Al, Al-5.0 Zr wt. %, Al-5.0 Er wt. %, Al-12 Si wt. %, 99.99 wt. % pure Sn, and 99.99 wt. % pure In and 99.99 wt. % pure Sb were melted in alumina crucibles in air. The melt was held for 60 minutes at 800° C., stirred vigorously, and then cast into a graphite mold, which was optionally preheated to 200° C. The mold was placed on an ice-cooled copper platen during solidification to enhance directional solidification and decrease formation of shrinkage cavities. The alloy's chemical composition was measured by direct-current plasma atomic-emission spectroscopy (DCP-AES).

TABLE 2

| Alloy | Nominal Composition, at. % | Measured Composition, at. % (DCP-AES) |
|---|---|---|
| 5 | A1-0.1 Zr-0.04 Er | A1-0.089 Zr-0.041 Er |
| 6 | A1-0.1 Zr-0.04 Er-0.01 Sn | A1-0.077 Zr-0.040 Er-0.008 Sn |
| 7 | A1-0.1 Zr-0.04 Er-0.02 Sn | A1-0.086 Zr-0.044 Er-0.018 Sn |
| 8 | A1-0.1 Zr-0.04 Er-0.17 Si | A1-0.074 Zr-0.036 Er-0.16 Si |
| 9 | A1-0.1 Zr-0.04 Er-0.02 In | A1-0.125 Zr-0.042 Er-0.026 In |
| 10 | A1-0.1 Zr-0.04 Er-0.02 Sb | A1-0.068 Zr-0.037 Er-0.014 Sb |

Isochronal Aging Heat Treatment

Figure 5A:
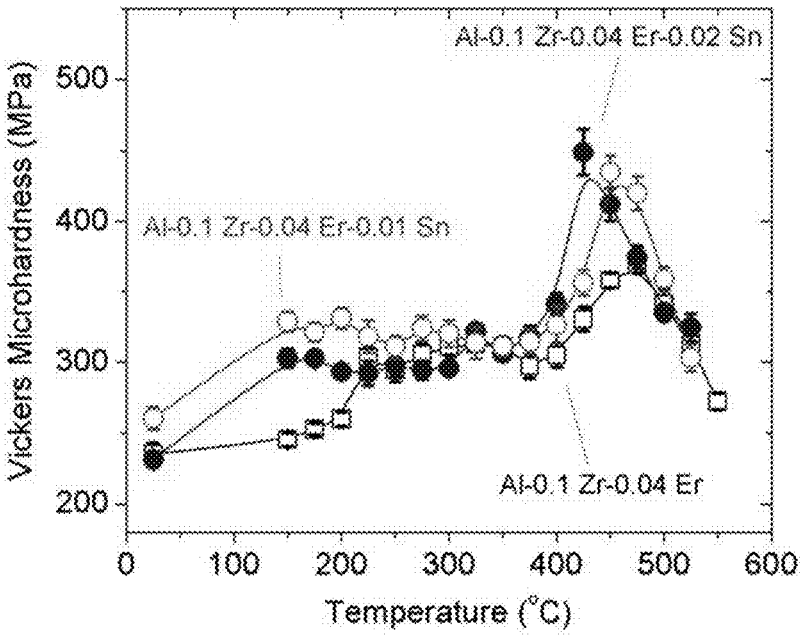
FIGS. 5A and 5B show the temporal evolution of the Vickers microhardness, FIG. 5A, and electrical conductivity at room temperature, FIG. 5B, during isochronal aging in steps of 25° C./3 hours for Al-0.1 Zr-0.04 Er at. %, Al-0.1 Zr-0.04 Er-0.01 Sn at. % and Al-0.1 Zr-0.04 Er-0.02 Sn at. %, after homogenization at 640° C. (1184° F.) for 24 hours.
Figure 5B:
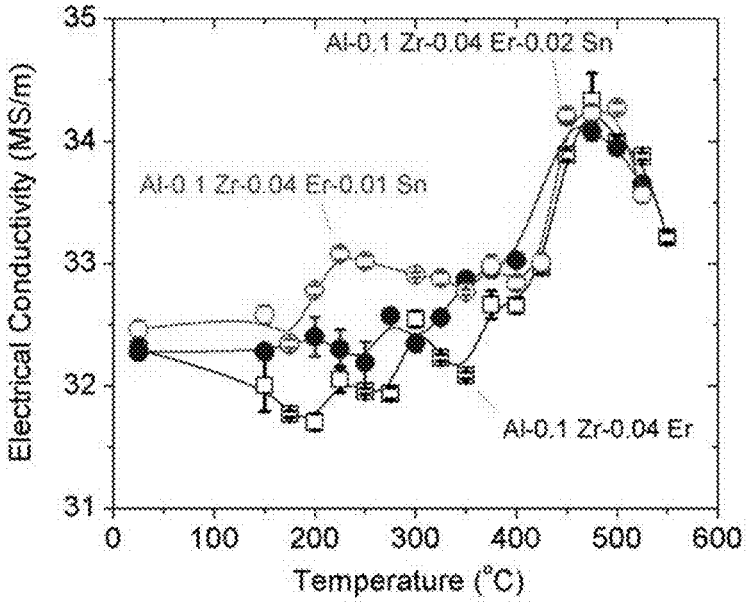

The temporal evolutions of microhardness and electrical conductivity were measured for Alloys 5-7 during isochronal aging treatments in stages of 25° C./3 hours, following homogenization at 640° C. for 24 hours, and are shown in FIGS. 5A and 5B. In the Al-0.1 Zr-0.04 Er control alloy without inoculants, the microhardness commences to increase at 200° C., peaking for the first time at 325° C. with a microhardness of 313±3 MPa. It then decreases at higher temperatures, but increases again at 400° C., peaking at 475° C. for the second time with a microhardness of 369±6 MPa. The first peak-microhardness is due to the formation of $Al_3Er$ precipitates, and the second peak-microhardness is due to precipitation of $Al_3Zr$ precipitates. The microhardness values decrease continuously above an aging temperature of 475° C. due to both precipitation coarsening and dissolution of the precipitates. In the Al-0.1 Zr-0.04 Er-0.01 Sn alloy, the microhardness values commence to increase at very low temperatures, possibly lower than 150° C., peaking at 200° C. for the first time with a microhardness of 331±8 MPa. It then saturates at higher temperatures, but increases again at 400° C., peaking at 450° C. for the second time with a microhardness of 435±12 MPa, which is greater than for the control alloy. The microhardness decreases continuously above an aging temperature of 450° C. In the Al-0.1 Zr-0.04 Er-0.02 Sn alloy, the microhardness commences to increase at very low temperature, possibly lower than 150° C., peaking at about 150° C. for the first time with a microhardness of 303±6 MPa. The microhardness then saturates at higher temperatures, but increases again at 375° C., peaking at about 425° C. for the second time with a microhardness of 449±16 MPa, which is greater than the control and Al-0.1 Zr-0.04 Er-0.01 Sn alloy. The microhardness decreases continuously above an aging temperature of 425° C.

The temporal evolution of the electrical conductivity of Al-0.01 Zr-0.04 Er, Al-0.01 Zr-0.04 Er-0.01 Sn, and Al-0.01 Zr-0.04 Er-0.02 Sn, following homogenization at 640° C. for 24 hours, are similar. With a relatively high degree of fluctuation, the electrical conductivity values of the homogenized states are in the range from 32.2 to 32.5 MS/m. They commence to increase at 350° C. to 400° C. then peak at 475° C. with a value of 34.33±0.23 (59.2% IACS) for Al-0.01 Zr-0.04 Er, at 500° C. with a value of 34.27±0.06 (59.1% IACS) for Al-0.01 Zr-0.04 Er-0.01 Sn, and at 450° C. with a value of 34.20±0.06 (59.0% IACS) for Al-0.01 Zr-0.04 Er-0.02 Sn.

Figure 6A:
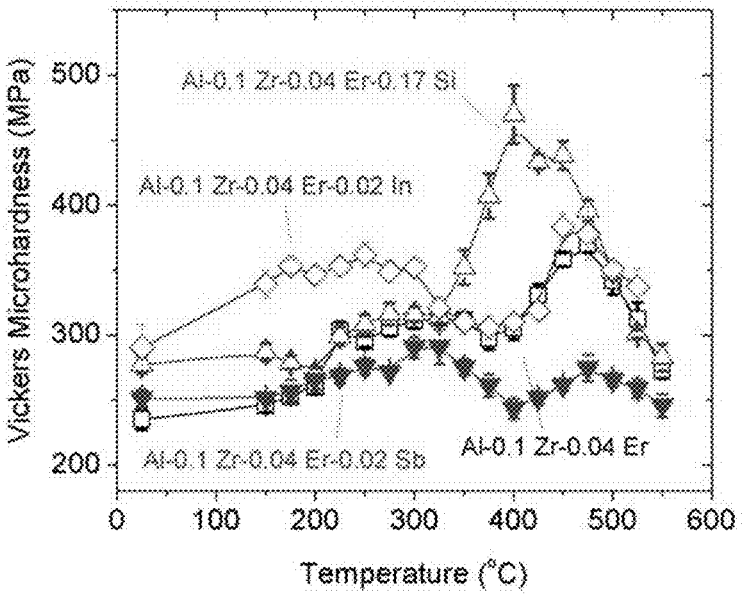
FIGS. 6A and 6B show the temporal evolution of the Vickers microhardness, FIG. 6A, and electrical conductivity at room temperature, FIG. 6B, during isochronal aging in steps of 25° C./3 hours for Al-0.1 Zr-0.04 Er at. %, Al-0.1 Zr-0.04 Er-0.02 In at. %, Al-0.1 Zr-0.04 Er-0.02 Sb at. % and Al-0.1 Zr-0.04 Er-0.17 Si at. %, after homogenization at 640° C. (1184° F.) for 24 hours.
Figure 6B:
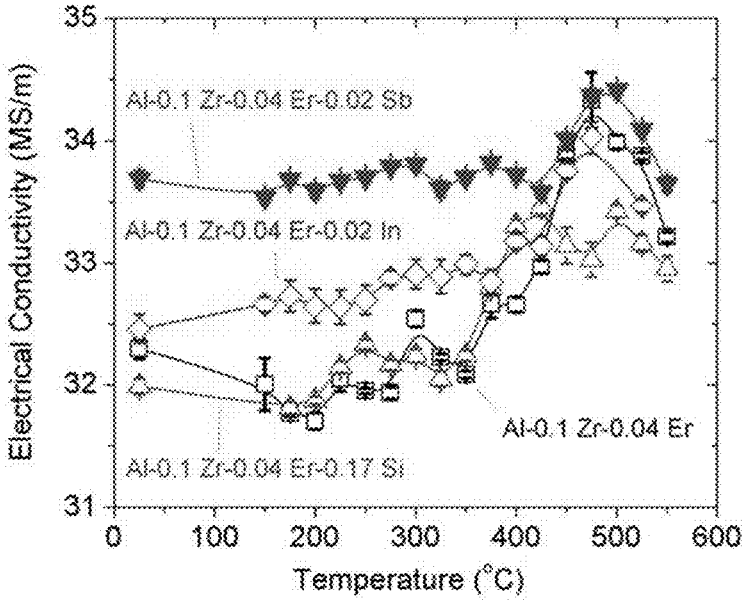

The temporal evolution of the microhardness and electrical conductivity values of Alloys 5 (the control alloy) and 8-10 during isochronal aging treatment in stages of 25° C./3 hours, following homogenization at 640° C. for 24 hours, are shown in FIGS. 6A and 6B. For the Al-0.1 Zr-0.04 Er-0.17 Si alloy, the microhardness commences to increase at 225° C., peaking at about 275° C. for the first time with a microhardness of 316±8 MPa. It then saturates at higher temperatures, but increases again at 350° C., peaking at about 400° C. for the second time with a microhardness of 470±22 MPa, which is greater than the control alloy without an inoculant. The microhardness decreases continuously beyond an aging temperature of 400° C. In the Al-0.1 Zr-0.04 Er-0.02 In alloy the microhardness commences to increase at a very low temperature, possibly lower than 150° C., peaking at about 250° C. for the first time a the microhardness of 362±10 MPa. It then decreases at higher temperatures, but increases again at 425° C., peaking at 450° C. for the second time with a microhardness of 383±11 MPa, which is again greater than the control alloy. The microhardness decreases continuously above an aging temperature of 425° C. The temporal evolution of the microhardness of Al-0.1 Zr-0.04 Er-0.02 Sb exhibits a distinct difference compared to the earlier ones. It commences to increase at 150° C., peaking at about 325° C. for the first time with a microhardness of 291±13 MPa, then decreases at higher temperatures, but increases again at 425° C., peaking at about 475° C. for the second time at 275±10 MPa, which is smaller than for the control alloy. The microhardness decreases continuously above an aging temperature of 475° C.

For the Al-0.01 Zr-0.04 Er-0.02 In alloy, FIG. 6B, the electrical conductivity of the homogenized state is 32.46±0.12, which increases continuously to 400° C., before rapidly increasing and peaking at 475° C. with the value 34.03±0.13 (58.7% IACS). The electrical conductivity of the Al-0.01 Zr-0.04 Er-0.02 In alloy at a temperature of about 150° C. to about 400° C. is greater than that of the control alloy. In the Al-0.01 Zr-0.04 Er-0.17 Si alloy, the electrical conductivity of the homogenized state is 32.00±0.07, which starts to increase at 350° C., peak at 425° C. with the value 33.46±0.08 (57.7% IACS), and then saturates until 525° C. where it commences decreasing. In the Al-0.01 Zr-0.04 Er-0.02 Sb alloy, FIG. 6B, the electrical conductivity of the homogenized state is 33.69±0.07, which commences to increase at 450° C., peaks at 500° C. with the value 34.41±0.04 (59.3% IACS), and then decreases below 500° C.

Figure 7A:
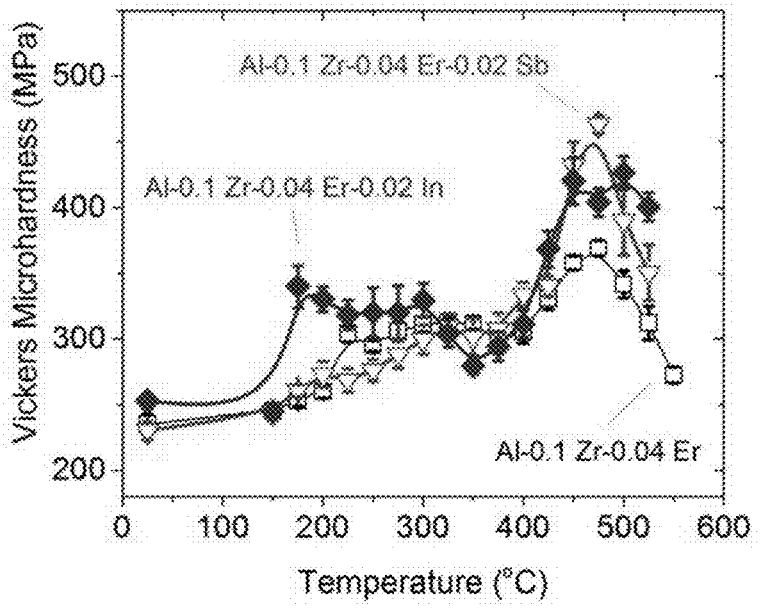
FIGS. 7A and 7B show the temporal evolution of the Vickers microhardness, FIG. 7A, and electrical conductivity at room temperature, FIG. 7B, during isochronal aging in steps of 25° C./3 hours for Al-0.1 Zr-0.04 Er at. %, after homogenization at 640° C. (1184° F.) for 24 hours, and Al-0.1 Zr-0.04 Er-0.02 In at. %, Al-0.1 Zr-0.04 Er-0.02 Sb at. %, without homogenization.
Figure 7B:
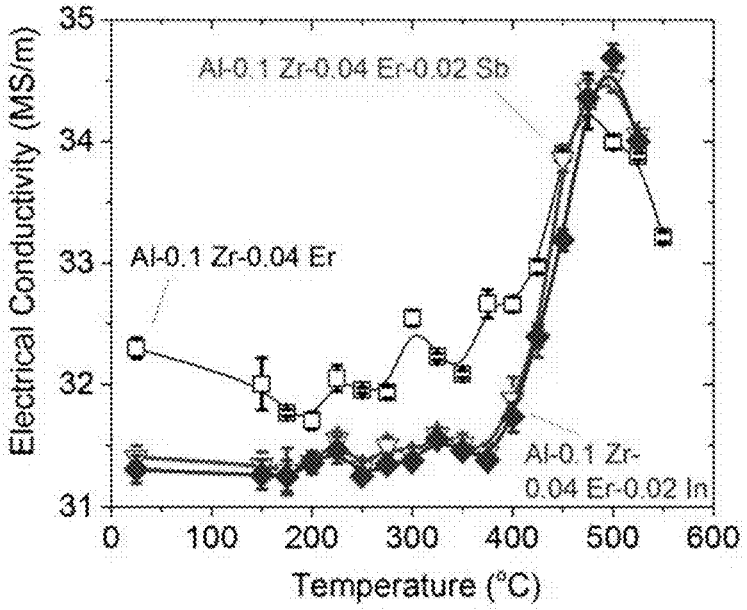

The temporal evolution of the microhardness and electrical conductivity values of Alloys 9-10 during isochronal aging treatment in stages of 25° C./3 hours, without homogenization, and Alloy 5 (the control alloy), following homogenization at 640° C. for 24 hours, are shown in FIGS. 7A and 7B. For the Al-0.1 Zr-0.04 Er-0.02 In alloy, the microhardness commences to increase at 150° C., peaking at about 175° C. for the first time with a microhardness of 340±16 MPa. It saturates from 175° C. to 300° C., then decreases to 350° C. but increases again at 375° C., peaking at about 500° C. for the second time with a microhardness of 427±13 MPa, which is greater than the control alloy without an inoculant. For the Al-0.1 Zr-0.04 Er-0.02 Sb alloy, the microhardness commences to increase at 150° C., peaking at about 200° C. for the first time with a microhardness of 273±10 MPa. It saturates from 200° C. to 250° C., then increases again at 250° C., peaking at about 475° C. for the second time with a microhardness of 463±7 MPa, which is greater than the control alloy without an inoculant.

For the Al-0.01 Zr-0.04 Er-0.02 In alloy, FIG. 7B, the electrical conductivity of the as-cast state is 31.25±0.12, which saturates to 375° C., before rapidly increasing and peaking at 500° C. with the value 34.69±0.11 (59.8% IACS). In the Al-0.01 Zr-0.04 Er-0.02 Sb alloy, the electrical conductivity of the as-cast state is 31.40±0.09, which saturates to 375° C., before rapidly increasing and peaking at 500° C. with the value 34.52±0.12 (59.5% IACS).

The addition of any of 0.17 Si, 0.01 Sn, 0.02 Sn, 0.02 In, or 0.02 Sb as inoculants to a Al-0.1 Zr-0.04 Er alloy provides a means for improving microhardness, thus mechanical strength, while maintaining the same relatively high electrical conductivity at peak microhardness. The inoculant facilitates the early formation of precipitates at low temperatures. The precipitates are nanosized and are less than about 20 nm in diameter and are believed to be less than about 10 nm.

Electrical and thermal conductivities are known to be correlated with one another, so that an improvement in electrical conductivity described herein likely results in a corresponding improvement in thermal conductivity.

Figure 8B:
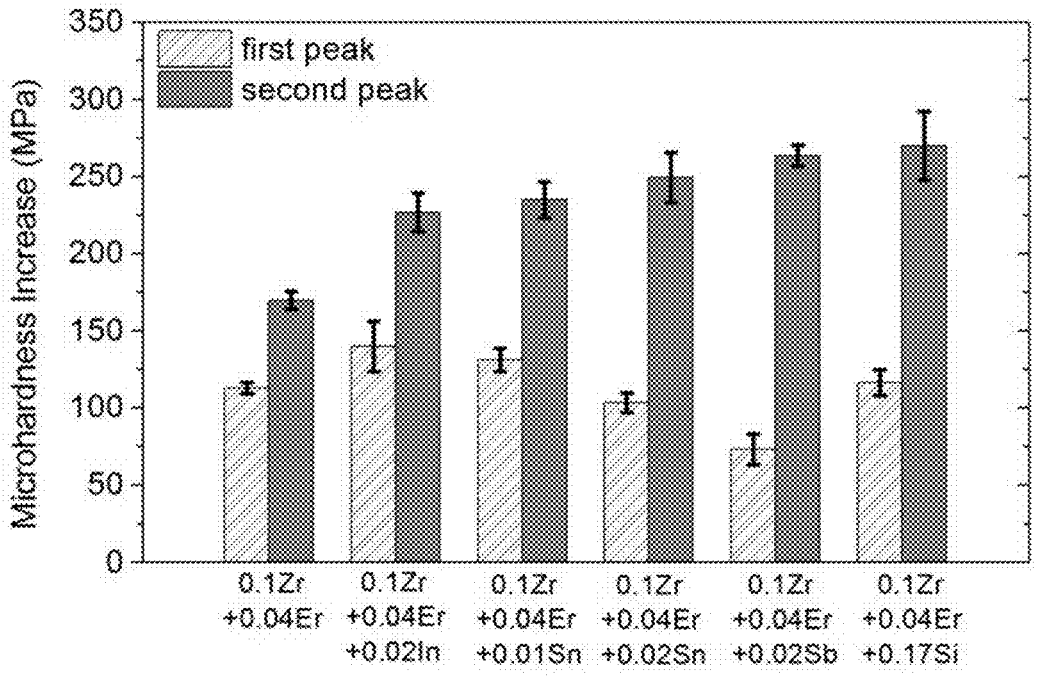
FIG. 8B is a summary illustration of the microhardness increases, from the base value of 200 MPa, of the first and second peak-hardness, during isochronal aging in steps of 25° C./3 hours for Al-0.1 Zr-0.04 Er at. %, Al-0.1 Zr-0.04 Er-0.01 Sn at. %, Al-0.1 Zr-0.04 Er-0.02 Sn at. %, Al-0.1 Zr-0.04 Er-0.17 Si at. %, after homogenization at 640° C. (1184° F.) for 24 hours; and Al-0.1 Zr-0.04 Er-0.02 In at. %, Al-0.1 Zr-0.04 Er-0.02 Sb at. %, without homogenization.

FIG. 8B is a summary illustration of the microhardness increases of the first and second peak-microhardness values, during isochronal aging in steps of 25° C./3 hours for all Al-0.1 Zr-0.04 Er-based alloys.

The foregoing description and-examples are intended as illustrative and are not to be taken as limiting what can be accomplished. Still other variations within the spirit and scope of this invention are possible and will present themselves to those skilled in the art and science of preparing alloys with specific goals for the electrical and thermal conductivities.

The invention claimed is:

1. An aluminum alloy comprising aluminum, zirconium, an inoculant, and a nanoscale precipitate comprising $Al_3Zr$, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the inoculant comprises one or more of Sn, In, Sb or Mg.

2. The aluminum alloy of claim 1, wherein the alloy contains no detectable amount of scandium up to about 0.04 at. % scandium (Sc).

3. The aluminum alloy of claim 1, further comprising a lanthanide series metal.

4. The aluminum alloy of claim 1, wherein the precipitate has an average diameter of about 10 nm or less, measured by atom-probe tomography technique.

5. The aluminum alloy of claim 1, wherein the nanoscale precipitate has an average diameter of about 4-6 nm.

6. The aluminum alloy of claim 1, wherein the nanoscale precipitate comprises $Al_3Zr$, $Al_3Er$, and $Al_3(Zr,Er)$.

7. The aluminum alloy of claim 1, further comprising a lanthanide series metal, and the alloy including a plurality of nanoscale $Al_3Zr$ precipitates, nanoscale $Al_3X$ precipitates, and nanoscale $Al_3(Zr,X)$ precipitates having an $L1_2$ structure, wherein X is a lanthanide series metal.

8. The aluminum alloy of claim 1, further comprising a lanthanide series metal, and the alloy including a plurality of nanoscale $Al_3Zr$ precipitates, nanoscale $Al_3X$ precipitates, and nanoscale $Al_3(Zr,X)$ precipitates having an $L1_2$ structure, wherein X is one or more of Ho, Er, Tm, and Yb.

9. The aluminum alloy of claim 1, further comprising a lanthanide series metal, and the alloy including a plurality of nanoscale $Al_3Zr$ precipitates and nanoscale $Al_3Er$ precipitates, and nanoscale $Al_3(Zr,Er)$ precipitates having an $L1_2$ structure.

10. The aluminum alloy of claim 1, wherein the inoculant comprises one or more of Sn, In and Sb, and the alloy being essentially scandium (Sc) free.

11. The aluminum alloy of claim 1, wherein the inoculant comprises one or more of Sn, In and Sb, and the alloy having less than about 0.04 at. % scandium (Sc).

12. The aluminum alloy of claim 1, further comprising Er and wherein the inoculant is one or more of Sn, In, and Sb, the alloy being essentially scandium-free and including a plurality of nanoscale $Al_3Zr$ precipitates, nanoscale $Al_3Er$ precipitates, and nanoscale $Al_3(Zr,Er)$ precipitates having a $L1_2$-structure.

13. The aluminum alloy of claim 1, wherein the nanoscale precipitate comprises $Al_3Zr$, $Al_3Er$, and $Al_3(Zr,Er)$ and the precipitates have an average diameter of about 10 nm or less.

14. The aluminum alloy of claim 1, wherein the nanoscale precipitate comprises $Al_3Zr$, $Al_3Er$, and $Al_3(Zr,Er)$ and the precipitates have an average diameter of about 4-6 nm.

15. An aluminum alloy component selected from the group of components consisting of a brake rotor, a piston, an auxiliary power unit, an auxiliary power unit frame, a mounting bracket, an aircraft engine exhaust duct comprising the aluminum alloy of claim 1.

16. The aluminum alloy of claim 1, wherein the inoculant comprises Sn.

17. The aluminum alloy of claim 1, wherein the inoculant comprises In.

18. The aluminum alloy of claim 1, wherein the inoculant comprises Sb.

19. The aluminum alloy of claim 1, wherein the inoculant comprises Mg.

20. An aluminum alloy comprising aluminum zirconium an inoculant and a nanoscale precipitate comprising $Al_3Zr$, wherein the nanoscale precipitate has an average diameter of about 20 nm or less and has an $L1_2$ structure in an α-Al face centered cubic matrix wherein the average number density of the nanoscale precipitate is about $10^{21}$ $m^{-3}$ or more, and wherein the inoculant comprises one or more of Ga, Ge, Pb, As or Bi.

21. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.3 at. % Zr, about 1.5 at. % Si, about 0.1 at. % Sn, about 0.1 at. % In, about 0.1 at. % Sb, the balance being Al.

22. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.1 at. % Zr, about 0.01 at. % Sn, the balance being aluminum.

23. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.1 at. % Zr, about 0.02 at. % Sn, the balance being aluminum.

24. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.06 at. % Zr, about 0.02 at. % In, the balance being aluminum.

25. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.3 at. % Zr, about 0.05 at. % Er, about 1.5 at. % Si, about 0.1 at. % Sn, about 0.1 at. % In, about 0.1 at. % Sb, the balance being aluminum, the alloy further including a plurality of nanoscale $Al_3Zr$ precipitates, nanoscale $Al_3Er$ precipitates, and nanoscale $Al_3(Zr,Er)$ precipitates having an $L1_2$-structure.

26. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.1 at. % Zr, about 0.04 at. % Er, about 0.01 at. % Sn, and the balance being aluminum, the alloy including a plurality of nanoscale $Al_3Zr$ precipitates, nanoscale $Al_3Er$ precipitates, and nanoscale $Al_3(Zr,Er)$ precipitates having an $L1_2$-structure.

27. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.1 at. % Zr, about 0.04 at. % Er, about 0.02 at. % Sn, the balance being aluminum, the alloy including a plurality of nanoscale $Al_3Zr$ precipitates, nanoscale $Al_3Er$ precipitates, and nanoscale $Al_3(Zr,Er)$ precipitates having an $L1_2$-structure.

28. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.1 at. % Zr, about 0.04 at. % Er, about 0.2 at. % Si, the balance being aluminum, the alloy including a plurality of nanoscale $Al_3Zr$ precipitates, nanoscale $Al_3Er$ precipitates, and nanoscale $Al_3(Zr,Er)$ precipitates having an $L1_2$-structure.

29. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.1 at. % Zr, about 0.04 at. % Er, about 0.02 at. % In, the balance being aluminum, the alloy including a plurality of nanoscale $Al_3Zr$ precipitates, nanoscale $Al_3Er$ precipitates, and nanoscale $Al_3(Zr,Er)$ precipitates having an $L1_2$-structure.

30. An aluminum alloy comprising aluminum, zirconium, an inoculant, and a nanoscale $Al_3Zr$ precipitate, wherein the nanoscale precipitate has an average diameter of about 20 nm or less and has an $L1_2$ structure in an α-Al face centered cubic matrix, wherein the average number density of the nanoscale precipitate is about $10^{21}$ $m^{-3}$ or more, and wherein the alloy is about 0.1 at. % Zr, about 0.04 at. % Er, about 0.02 at. % Sb the balance being aluminum, the alloy including a plurality of nanoscale $Al_3Zr$ precipitates, nanoscale $Al_3Er$ precipitates, and nanoscale $Al_3(Zr,Er)$ precipitates having an $L1_2$-structure.

31. An aluminum alloy having the combination Al—Zr—Er—X—Si, wherein X comprises one or more of Sn, In, or Sb, Si is an alloying element, the alloy having no more than about 0.17 at. % Si, and the alloy including a plurality of $Al_3Zr$, $Al_3Er$, and $Al_3(Zr,Er)$ nanoscale precipitates having an $L1_2$-structure wherein the average number density of the nanoscale precipitates is about $10^{21}$ $m^{-3}$ or more.

* * * * *